United States Patent [19]

Brinton et al.

[11] 4,391,239

[45] Jul. 5, 1983

[54] INVERSION PROTECTION OF OUTBOARD MARINE ENGINES

[75] Inventors: Michael B. J. Brinton, East Cowes; John Barnes; Peter D. Chandler, both of Newtown, all of England

[73] Assignee: R.N.L.I. (Trading) Limited, Dorset, England

[21] Appl. No.: 174,766

[22] Filed: Aug. 4, 1980

[51] Int. Cl.[3] ..... F02B 77/00

[52] U.S. Cl. ..... 123/198 E; 123/195 C; 123/198 D

[58] Field of Search ..... 123/198 E, 195 C, 195 S, 123/198 D

[56] References Cited

U.S. PATENT DOCUMENTS

| | | | |
|---|---|---|---|
| 2,676,559 | 4/1954 | Davies | 123/198 E |
| 2,792,821 | 5/1957 | Kiekhaeffer | 123/198 E |
| 2,798,470 | 7/1957 | Kiekhaefer | 123/198 E |
| 2,839,042 | 6/1958 | Armstrong et al. | 123/198 E |
| 2,909,031 | 10/1959 | Kiekhaefer | 123/198 E |
| 3,358,668 | 12/1967 | Post et al. | 123/198 E |
| 4,153,034 | 5/1979 | Sato et al. | 123/198 E |

*Primary Examiner*—Ira S. Lazarus

*Attorney, Agent, or Firm*—Howard L. Rose

[57] ABSTRACT

Inversion-protection of an outboard marine engine is achieved by fitting inside the engine casing watertight boxes to enclose the water-sensitive electrical components, i.e. the engine starter solenoid and the power pack. The starter motor spindle is provided with a shaft seal and the engine exhaust is fitted with an exhaust pipe in the form of a vertical hairpin or U-tube. The engine air intake box has fitted inside it a horizontally sliding valve that is automatically closed by a vertically-sliding weighted wedge engaging the valve rod.

10 Claims, 10 Drawing Figures

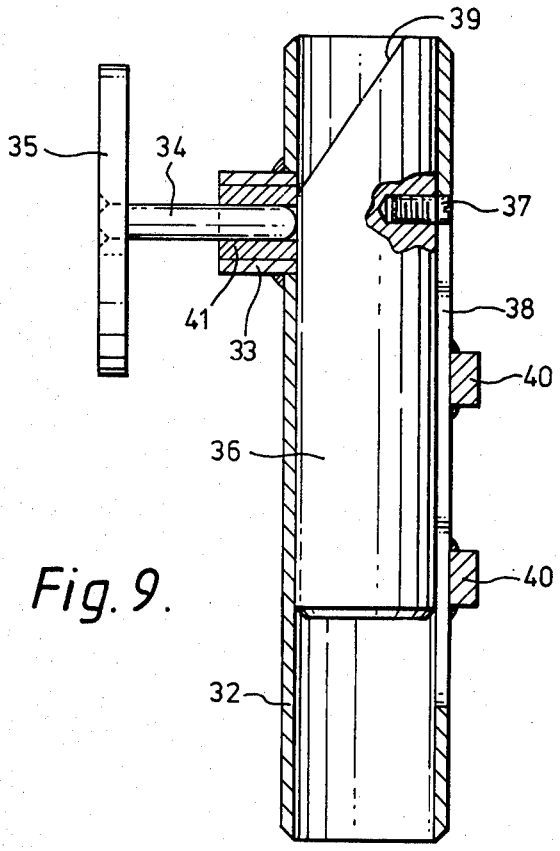
Fig. 9.
Fig. 10.
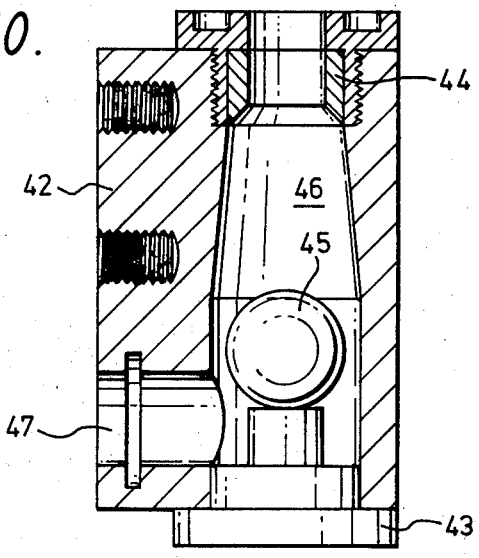

INVERSION PROTECTION OF OUTBOARD MARINE ENGINES

This invention relates to the inversion-protection of outboard marine engines so that they will still function after capsize and righting of the craft to which they are fitted.

For a number of years, outboard engines on the semi-rigid inflatable rescue boats of the Royal National Lifeboat Institution have been protected against the event of capsize by a process of fitting special water-excluding seals to all entry points of the engine casing, providing special water-excluding valves, and so on. This has been a success technically but the adaption of each engine has been a time-consuming and costly operation. Not only must the special seal members be fitted with great care but also the engine mountings need to be stiffened to ensure that the seals are not broken by vibration in use. Furthermore, the automatic valves that have been employed, operating upon inversion to seal off the air intake and engine exhaust, are comparatively expensive to make.

It is an object of this invention to simplfy the whole procedure of protecting an engine against inversion, so that it can be carried out in considerably less time and at much less expense.

The present invention provides a method of inversion-protecting an outboard marine engine, wherein water-sensitive electrical equipment within the engine casing is enclosed in one or more watertight boxes fitted inside the casing, the casing itself being left without additional sealing against water ingress.

The starter motor spindle may be fitted with a shaft seal, and, instead of an automatic water-excluding exhaust valve, the engine exhaust may be fitted with an exhaust pipe of substantially vertical hairpin or U-tube configuration.

Preferably, the engine air intake is fitted with an automatic valve comprising a circular valve head carried on a slidably mounted valve rod that is operated by direct contact with a weighted wedge sliding substantially vertically in a guide tube to close the valve when the engine is inverted.

Figure 1:
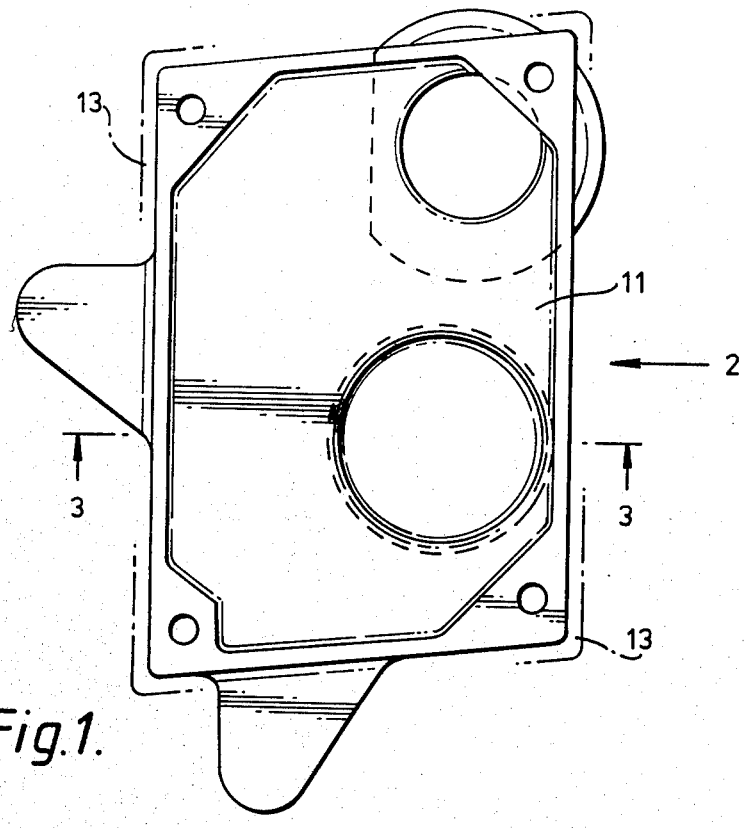
Figure 2:
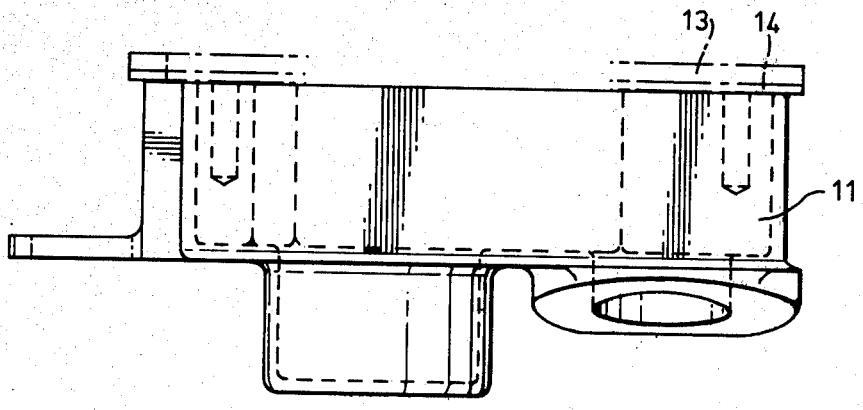
Figure 3:
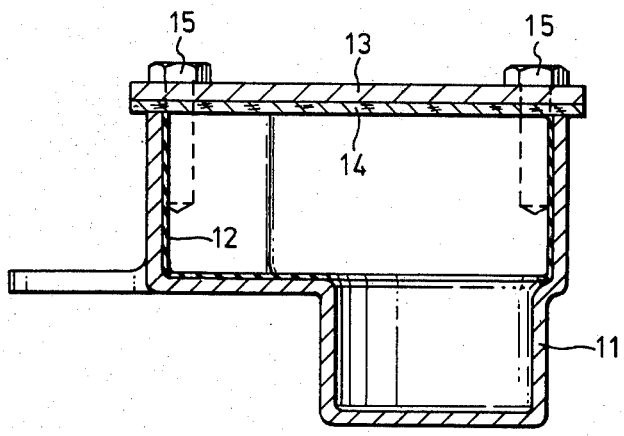
Figure 6:
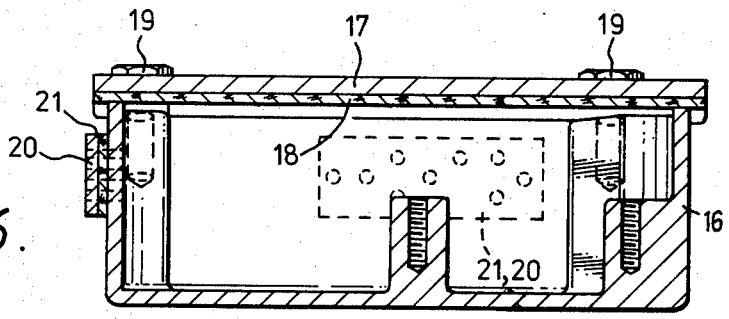
Figure 8:
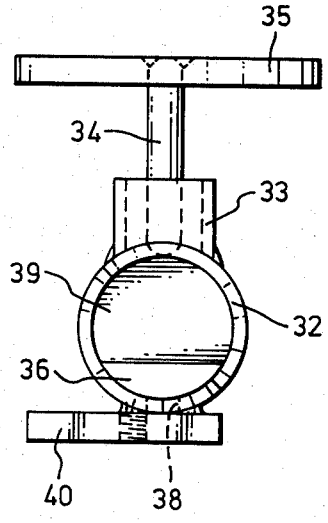
Figure 4:
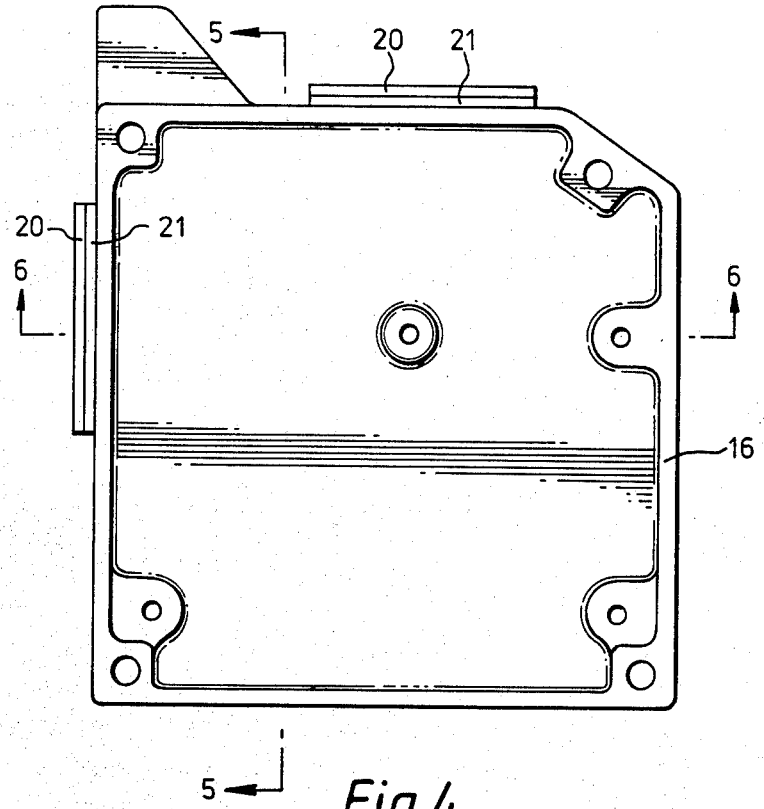
Figure 5:
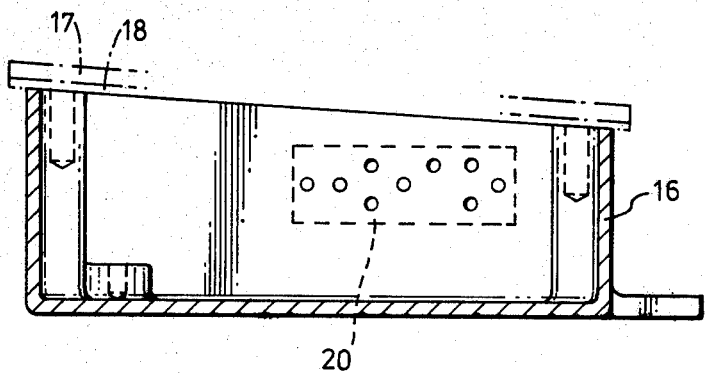
Figure 7:
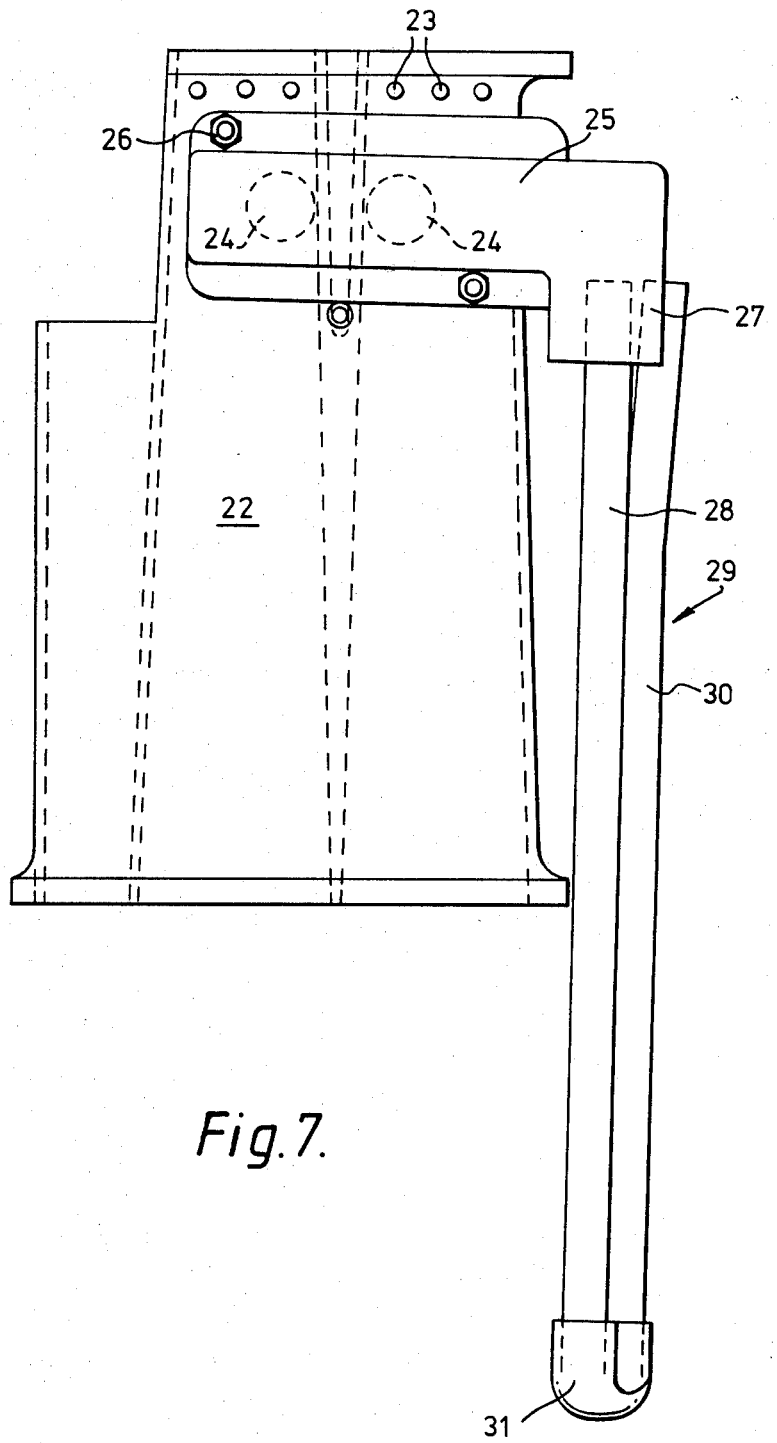

A preferred manner of carrying the invention into effect will now be described in more detail, applied to a 55 H.P. Evinrude engine, by way of example, reference being had to the accompanying drawings in which:

FIG. 1 shows in plan a box, without its lid, to enclose the starter solenoid of the engine to be protected, FIG. 2 is a view of the solenoid box in the direction of the arrow 2 of FIG. 1, FIG. 3 shows the solenoid box, complete with lid, in section on the line 3—3 of FIG. 1, FIG. 4 shows in plan a box without its lid, to enclose the power pack of the engine to be protected, FIG. 5 is a view in section on the line 5—5 of FIG. 4, FIG. 6 shows the power pack box, complete with lid, in section on the line 6—6 of FIG. 4, FIG. 7 shows how an exhaust U-tube is fitted to the engine exhaust housing, FIG. 8 shows in plan a valve to prevent entry of water through the engine intake, FIG. 9 is an elevation, in longitudinal section, of the valve of FIG. 8, and FIG. 10 is an elevation, in section, of a ball valve for fitting to each carburetter balancing hole.

As already stated, no attempt is made to prevent water entry into the engine casing but the water-sensitive electrical equipment inside the casing is protected by being housed in sealed water-tight boxes. Taking the 55 H.P. Evinrude engine as our example, it is convenient to provide two sealed boxes inside the engine casing on opposite sides of the engine, one box containing the starter solenoid and starter circuit fuse, and the other containing the power pack including the coil and the terminal blocks. FIGS. 1 to 3 show the solenoid box 11 which is partially lined internally with Hypalon-coated nylon 12 and has a lid 13 and neoprene gasket 14 secured by studs 15. FIGS. 4 to 6 show the power pack box 16 which has a lid 17 and neoprene gasket 18 secured by studs 19, two of the side walls of this box being fitted with gland plates 20, with gaskets 21, for the entry and exit of electrical leads. Also, an O-ring shaft seal is fitted to the starter where the spindle emerges in order to prevent ingress of water to the motor.

To prevent ingress of water through the engine exhaust we have now discovered that it is only necessary to fit on to the engine exhaust a simple U-tube. A suitable tube is of sharp bend hairpin configuration and has a diameter of about ½" with each leg about 1 ft long. In the event of a capsize, the then upturned U-tube very effectively prevents the passage of water into the engine exhaust.

FIG. 7 shows the inner exhaust housing 22 of the engine with the twelve original 3/16" diameter exhaust ports 23 closed by welding and two fresh ¾" diameter ports 24 cut below them, the ports 24 being covered by an exhaust manifold 25 secured by bolts 26. The manifold 25 is of elbow form terminating in a short vertical limb 27 which is downwardly-directed and internally threaded to receive the threaded upper end of one substantially vertical leg 28 of the hairpin or U-shaped exhaust tube 29. The other leg 30 of the exhaust tube 29 ties alongside the leg 28 and in united to it at the lower ends of the legs by a threaded U-bend connector 31, the upper end of the leg 30 being open to the atmosphere. Each of the legs 28,30 of the exhaust tube 29 is 1 ft long and made of stainless steel tubing of ½" outside diameter.

It is still, however, necessary to employ an automatic valve to prevent entry of water through the engine air intake. Again taking the 55 H.P. Evinrude as our example, this engine has an air intake box into which the air is admitted through an aperture in one vertical wall of the box. To install the automatic inversion protection valve, shown in FIGS. 8 and 9, the existing intake is blanked off and a fresh circular intake opening is formed in the opposite vertical wall of the box. A guide in the form of a slotted tube 32 of 1½" outside diameter, with external locating lugs 40, is fixed upright inside the air box close to the wall with the blanked-off opening so that the vertical axis of the guide tube and the horizontal axis of the new intake opening lie at right angles to one another in the same vertical plane. In alignment with the intake opening axis the guide tube 32 has a short horizontal side branch tube 33 of smaller diameter which contains a bearing bush 41 that forms a slide for a valve rod 34 that extends into the slotted vertical guide tube 32 at one end while its opposite end beyond the end of the side branch tube 33 carries a valve head 35 to co-operate with the air intake opening. The valve head 35 is a simple circular valve plate with a rubber face to seat against the intake opening and close it.

Inside the slotted vertical guide tube 32 there is a circular weight 36 dimensioned to slide within the tube and having a pin 37 engaged in the vertical slot 38 of the tube so that it cannot rotate in the tube. At the side nearer the air-intake opening and valve the weight 36 has formed at its upper end a sloping wedge face 39. During normal operation of the engine, the weight 36 lies at the bottom of the guide tube 32, the valve is open and the wedge face 39 is out of contact with the inner end of the valve rod 34. Should the assembly be inverted, as in the case of a capsize, the weight falls toward the opposite end of the guide tube and as it does so the wedge face 39 strikes the inner end of the valve rod 34 and cams the valve 35 out against the intake opening to close it and prevent ingress of water. This action is very rapid and positive. In the drawings, the weight 36 and valve 35 are shown in the positions they would occupy if the assembly were inverted.

The whole valve assembly is housed inside the existing air box on the engine and the valve 35 does not need a valve spring because, in the normal upright position, the valve can slide freely inward and, when the engine is running, the engine suction is quite sufficient to open the valve and hold it open.

A problem that occurs with the carburetters is that there is a balancing hole for each carburetter which opens into the air intake box, and when the engine is inverted fuel drains out through the hole into the intake box. Apart from the consequent risk of fire or explosion, this drains the carburetter float chambers so that when the engine is righted the carburetters have to be primed before the engine will start. The problem is overcome by fitting a simple ball valve on to each balancing hole inside the air intake box. FIG. 10 shows such a valve consisting of a valve block 42 containing a vertical passage 46, a plug 43 closing the lower end of the passage and a valve seat 44 fitted into the upper end of the passage, and a loose phosphor bronze valve ball 45 inside the passage. When the engine is operating normally, the ball 45 remains resting on the plug 43 as shown and allows the carburetter to communicate, through a side entry 47 of the valve block, with the air intake box. If the engine is inverted, the ball 45 falls on to the valve seat 44 to cut off this communication.

While to illustrate the principles and practice of the invention the 55 H.P. Evinrude engine has been chosen as an example, it will be understood that the invention is not limited to this but the technique can be employed similarly for the inversion-protection of other outboard marine engines.

We claim:

1. A method of inversion-protecting an outboard marine engine having a starter motor, spindle, and solenoid and engine power pack including a coil and terminal blocks located in a main engine casing, wherein all of the water-sensitive electrical equipment within the main engine casing is enclosed in one or more watertight boxes fitted inside the casing, the casing itself being open to ingress of water and protecting all other water sensitive engine regions from ingress of water upon inversion of the engine.

2. A method according to claim 1, wherein the engine starter solenoid is enclosed in one watertight box and the engine power pack, including the coil and terminal blocks, is enclosed in another watertight box.

3. A method according to claim 1 or claim 2, wherein the starter motor spindle is sealed against water ingress.

4. A method according to claim 1 or claim 2 or claim 3, wherein air is trapped in an exhaust tube fitted to the engine exhaust when the engine is inverted.

5. An outboard marine engine having an engine, a main engine casing open to water and having located therein a starter motor with a spindle, a starter motor solenoid, an engine power pack including a coil and terminal blocks wherein the engine has an air intake, an exhaust housing, a carburetor with balancing holes characterized in that there is provided, at least one water tight compartment for the starter motor, starter motor solenoid, an engine power pack including a coil and terminal blocks, and a gravity operated valve means for sealing said exhaust part when said engine is inverted.

6. Apparatus for inversion-protecting an outboard marine engine according to claim 5, comprising a first watertight box adapted to fit inside the engine casing and enclose the engine starter solenoid and starter circuit fuse, and a second watertight box adapted to fit inside the engine casing and enclose the engine power pack.

7. Apparatus according to claim 6, further comprising an exhaust pipe of hairpin or U-tube configuration to fit substantially vertically on to the engine exhaust housing.

8. An engine according to claim 5 wherein said valve means comprises a valve head of the same shape as the intake part, a slidably mounted rod vertically situated in a quiescent position when the engine is in its upright position and is in an active position when said engine is inverted, and means for sealing said valve head in said intake part when said rod is in its active position.

9. An engine according to claim 8, said rod having a tapered surface, a valve actuating member contacting said tapered surface at right angles thereto.

10. An engine according to claim 5 further characterized by a ball valve for each said carburetor balancing holes, and means causing said ball valves to close each of said balancing holes when said engine is inverted.

* * * * *